US006121167A

United States Patent [19]

Okamoto

[11] Patent Number: 6,121,167

[45] Date of Patent: Sep. 19, 2000

[54] MOISTURE-CONTROLLED CURING DURABLE PRESS PROCESS

[76] Inventor: Hiroharu Okamoto, 32 Beverly Rd., Great Neck, N.Y. 11021

[ * ] Notice: This patent issued on a continued prosecution application filed under 37 CFR 1.53(d), and is subject to the twenty year patent term provisions of 35 U.S.C. 154(a)(2).

[21] Appl. No.: 09/137,294

[22] Filed: Aug. 20, 1998

Related U.S. Application Data

[60] Provisional application No. 60/056,823, May 22, 1997.

[51] Int. Cl.[7] ..... B32B 9/04; B05F 3/02

[52] U.S. Cl. ..... 442/153; 427/553; 427/557; 427/392; 427/393.2; 427/396

[58] Field of Search ..... 442/153; 427/553, 427/557, 392, 393.2, 396

[56] References Cited

U.S. PATENT DOCUMENTS

| | | | |
|---|---|---|---|
| Re. 30,860 | 2/1982 | Swidler et al. | 8/116.4 |
| 2,243,765 | 5/1941 | Morton . | |
| 3,663,974 | 5/1972 | Watanabe et al. . | |
| 3,841,832 | 10/1974 | Swidler et al. . | |
| 4,108,598 | 8/1978 | Payet . | |

FOREIGN PATENT DOCUMENTS 980980 1/1965 United Kingdom .

OTHER PUBLICATIONS

T. Masuda et al.l "Textile Finishing Technology; New Edition (Shinpan; Jushi Kako Gijutsu)", Chijin Shokan, Tokyo, Japan; P6–P142; Oct. 10, 1989.

*Primary Examiner*—Christopher Raimund

*Attorney, Agent, or Firm*—Pennie & Edmonds LLP

[57] ABSTRACT

A wrinkle-free/wrinkle-resistant cellulosic fiber-containing fabric which retains tensile-, tear- and abrasion-strength due to the reduction of hydrogen bonding in the fabric is obtained by a process which comprises pretreating the fabric with the processes to reduce and control hydrogen bonding in the fabric, and treating a cellulosic fiber-containing fabric with aqueous formaldehyde and a catalyst in liquid form capable of catalyzing the cross-linking reaction between the formaldehyde and cellulose. Such cross-linking is carried out by heat-curing the cellulosic fiber-containing fabric under saturated steam with or without high pressure and/or infrared or far-infrared radiation and/or high frequency (induction) radio waves. Under such conditions the formaldehyde reacts with cellulose in the presence of catalyst with no substantial loss of formaldehyde prior to said reaction so as to improve the wrinkle-free or wrinkle-resistant property of the fabric without substantial strength loss. This is accomplished by maintaining the moisture level during curing high enough to prevent detrimental increase in hydrogen bonding above the reduced level of hydrogen bonding by the prior process of liquid ammonia treatment and/or aqueous wetting. Such precise control of moisture and formaldehyde at curing is also achieved by superheated steam cure, moist-cure, which controls the same level of moisture throughout the curing process, or mild-cure with steam lower than 212° F. (100° C.).

12 Claims, No Drawings

MOISTURE-CONTROLLED CURING DURABLE PRESS PROCESS

This application claims benefit of 60/056,823 filed Aug. 22, 1997.

TABLE OF CONTENTS

| | | Page |
|---|---|---|
| 1. | BACKGROUND OF THE INVENTION | 1 |
| | 1.1 Technical Field | 1 |
| | 1.2 Background Art | 1 |
| 2. | SUMMARY OF THE INVENTION | 5 |
| 3. | DESCRIPTION OF PREFERRED EMBODIMENTS | 16 |
| | 3.1 Example of Saturated Steam Cure (I) | 16 |
| | 3.2 Example of Saturated Steam Cure (II) | 16 |
| | 3.3 Example of Superheated Steam Cure | 17 |
| | 3.4 Example of Moist Cure | 17 |
| | 3.5 Example of Mild Cure | 18 |
| 4. | CLAIMS | 19 |
| 5. | ABSTRACT | 21 |

1. BACKGROUND OF THE INVENTION

1.1 Technical Field

The present invention is directed to making cellulosic fiber-containing fabric wrinkle-free/resistant by heat-curing using aqueous formaldehyde. More particularly, it relates to making a cellulosic fiber-containing fabric wrinkle-free/resistant by a heat-curing process ("durable press" process) using aqueous formaldehyde and catalyst under conditions whereby the moisture content of the fiber and the reduction of hydrogen bonds in the fiber can be controlled.

1.2 Background Art

In recent years, vapor phase formaldehyde cross-linking, with retention of water absorbency and natural softness, of cellulosic fiber-containing fabric, has been commercialized and proven to be advantageous compared to amino-plastic resin cross-linking. However, despite many attempts, aqueous formaldehyde cross-linking has not been successfully commercialized because of the prior inability to control precisely the formaldehyde content in the fabric due to its evaporation with water during the heat-curing process, as compared to no evaporation of amino-plastic resin during the heat-curing process.

For example, U.S. Pat. No. 4,108,598 describes an aqueous formaldehyde cross-linking process which employs a binder or thickening agent to prevent substantial loss of formaldehyde during curing, or alternatively, with heat-curing under a gradual temperature increase from low temperature to prevent substantial loss of formaldehyde after imparting a moisture content to the fabric of more than 20% by weight. However, such prior art process does not enable sufficient control of the moisture content in the fabric during the curing process. All commercial heat-curing or heat-setting equipment is designed for man-made fiber heat-setting and/or amino-plastic resin heat-curing, neither of which requires the control of moisture and temperature in several chambers precisely as does aqueous formaldehyde cross-linking.

The loss of moisture content in the fabric which occurs in prior art curing processes represents a serious drawback, namely, substantial strength loss due to the increase of hydrogen bonds or hydrogen bonding in the cellulosic fibers which accompanies the gradual decrease of moisture content in cellulosic fiber during heat-curing.

None of the prior art processes for aqueous formaldehyde cross-linking with catalysts, as described in the aforementioned U.S. Pat. No. 4,108,598, as well as in U.S. Pat. Nos. 2,243,765; 3,663,974; and 3,841,832; British Patent 980, 980; and Masuda et al., "Textile Finishing Technology" pages 6–142 (1989), has focused on the phenomenon of hydrogen bonding in cellulosic molecules or hydrogen bonding between water molecules and the cellulose molecules in the fiber, the control or elimination of which substantially and advantageously reduces the strength loss of the fabric. Such hydrogen bonding generally has three manifestations: inter-hydroxyl hydrogen bonding between hydroxyl groups on different cellulosic molecules, intra-hydroxyl hydrogen bonding between hydroxyl groups within the same cellulosic molecules, and hydrogen bonding between water molecules and hydroxyl substituents on cellulose molecules.

Although a hydrogen bond is not as strong as a covalent bond, it does have a bond strength of about 5 Kcal/mol. The collective presence of many hydrogen bonds in cellulosic fiber accounts for a substantial loss of tear and tensile strength and abrasion resistance. The reduction of hydrogen bonding in cellulosic fiber can be achieved either by aqueous wetting or by liquid ammonia treatment in a pre-treatment step, and maintaining enough moisture content to prevent an increase in hydrogen bonding caused by drying at curing.

Masuda et al., in *Textile Finishing Technology,* p. 116, report typical examples of the reduction of hydrogen bonding by mild cure (steam cure) as follows:

TABLE 1

Increase of tear, tensile and abrasion strength by preventing the increase of hydrogen bonding in cotton fabric using steam cure

| Resin | | Wrinkle-Resistance Warp + Filling, angle | | Weight loss by abrasion | Strength retention (Warp, %) | | | Moisture |
|---|---|---|---|---|---|---|---|---|
| Type | Curing | Dry | Wet | (weight %) | Abrasion | Tensile | Tear | Content (%) |
| A | Steam Cure 63.8° C., 5 min | 259° | 274° | 4.0 | 60 | 97 | 67 | 7.5 |
| B | Dry Cure 160 C., 3 min | 279° | 280° | 6.3 | 10 | 57 | 52 | 3.8 |
| Control | — | 196° | 191° | 0.7 | (960 times) | (23 kg) | 1153 g | 6.8 |

A: 20% DMMC; 1.2% catalyst ($MgCl_2.6H_2O$ 50%, citric acid 50%); 2% polyethylene; 0.1% wetting agent.

B: 10% DMMC; 3% catalyst ($MgCl_2.6H_2O$); 2% polyethylene; 0.1% wetting agent (Masuda et al., *Textile Finishing Technology* p. 116).

Table 1 shows to a great extent the remarkable effectiveness of steam curing with moisture in reducing strength loss while keeping high levels of durable press. However, this steam cure method has not been applied to catalytic, aqueous formaldehyde cross-linking of cellulosic fiber-containing fabrics.

In recent years, European mills have been using moist cure to prevent the increase of hydrogen bonds which would otherwise occur by drying at curing. A typical formulation, reported by Cotton Inc. is as follows:

TABLE 2

Moist Cure Crosslinking Formulation

| | % on weight of bath |
|---|---|
| Wetting Agent | 0.1 |
| DMDHEU (40%) | 20 |
| HCl (Conc.) | 4.0 |

Alkalinity 0.05% or less
Moisture 6–8%
Batch cure 15 to 24 hrs

Masuda et al., supra, report moist cure which imparts wrinkle-resistance in both dry and wet states, while preventing or inhibiting the increase in hydrogen bonding caused by drying at curing. However, the prior art does not teach the use of aqueous formaldehyde cross-linking with catalysts for moist cure instead of amino-plastic resin.

In summary, the prior art suffers from two major drawbacks:

(1) No prior art method using aqueous formaldehyde cross-linking with catalysts has been able to achieve precise control of the moisture content in cellulosic fiber to secure an adequate level of formaldehyde by preventing its evaporation with moisture at curing.

(2) No prior art method using aqueous formaldehyde cross-linking with catalyst has recognized the hydrogen bond-reduction curing process under which there is precise moisture control to reduce substantial strength loss by preventing the increase of hydrogen bonding in the extent of hydrogen bonding brought about at curing.

The present invention solves the above two problems simultaneously, which thereby also obviates the difficulty of applying catalytic formaldehyde cross-linking to 100% cotton light weight fabrics so as to retain enough tear strength, tensile strength and abrasion resistance to render such fabrics optimally marketable.

2. SUMMARY OF THE INVENTION

The present invention provides a durable press process that makes natural or artificial cellulosic fiber-containing fabrics (e.g., cotton, linen, ramie, regenerated cellulose, and blends thereof with other fibers such as polyester, nylon, etc.) wrinkle-free/resistant with better water absorbency and less strength-loss by using aqueous formaldehyde and catalyst under the control of moisture content in the fabric by the process of saturated steam cure, superheated steam cure, moist cure, mild cure, etc., with other factors such as high pressure, far infrared or infrared radiation and/or high frequency induction radio waves (microwaves), after reducing the hydrogen bonding in the cellulosic fiber-containing fabric with aqueous wetting and/or liquid ammonia treatment.

A durable press process according to the present invention that makes cellulosic fiber-containing fabric wrinkle-free or wrinkle-resistant comprises treating a cellulosic fiber-containing fabric with aqueous formaldehyde and a catalyst capable of catalyzing the cross-linking reaction between the formaldehyde and cellulose in the manner described below; heat-curing the treated cellulosic fiber-containing fabric in the presence of saturated steam with the help of high pressure (superheated steam) and/or infrared radiation and/or high frequency (induction) radio waves, under conditions at which formaldehyde reacts with cellulose in the presence of catalyst without any substantial loss of formaldehyde prior to the reaction of said formaldehyde with cellulose to impart wrinkle-free or wrinkle-resistant property to the fabric.

Gradual heating under precise moisture control in the heating environment can be used to prevent the substantial loss of formaldehyde before the reaction thereof with the cellulose and to control the increase in hydrogen bonding within the cellulosic fiber, instead of a single temperature, although the latter can be used if desired.

The exact temperature range and time during which the curing fabric will be at any given temperature will depend upon the particular catalyst being used, its concentration in solution and the amount of formaldehyde present, as well as the fabric being treated and the desired results. These factors would be readily appreciated by one skilled in the art. Generally, a temperature range of from 100° F. to 350° F. over a period of five minutes will yield good results. The treated fabric may be introduced into a heating zone and the temperature of the zone gradually increased. If a continuous process is desired, the treated fabric may be passed through zones of increasing temperatures to produce the necessary heating without substantial loss of formaldehyde. The number and temperature difference between zones is also not critical so long as the substantial loss of formaldehyde is prevented and moisture is controlled with sufficient precision.

In the first stage of the process of the present invention, the fabric is treated in the manner according to (A) or (B):

A. In the case of heat-curing processes which do not cause the fabric to lose moisture content, the fabric is treated to contain the precise volume of aqueous formaldehyde and/or of the catalyst necessary to obtain the desired level of cross-linking.

B. In the case of heat-curing processes which make the fabric lose its moisture content to a certain extent, the volume of aqueous formaldehyde and/or of the catalyst in the wetting process are increased to the same extent.

The present invention solves the aforementioned problems of the prior art by controlling the moisture content so as to preserve an adequate volume of aqueous formaldehyde and catalyst for the intended level of cross-linking in cellulosic fiber-containing fabric at the curing stage, retaining the same or a similar level of reduction of hydrogen bonding in cellulosic fiber achieved by aqueous wetting and/or by liquid ammonia treatment in a pre-treatment step as follows:

There are two methods to reduce hydrogen bonding in cellulosic fiber and to impregnate cellulosic fiber-containing fabric with aqueous formaldehyde and catalysts capable of catalyzing the cross-linking reaction between the formaldehyde and the cellulose.

(A) Aqueous wetting process.

The cellulosic fiber-containing fabric is processed by any convenient form of aqueous wetting such as padding, dipping, spraying etc. to reduce the extent of hydrogen bonding in cellulosic fiber and aqueous formaldehyde and catalysts.

(B) Liquid ammonia treatment process and aqueous wetting process.

In the event that aqueous wetting alone is not enough to reduce hydrogen bonding and increase the fabric's tear strength, tensile strength, and abrasion resistance, the fabric is at first processed by treating it with liquid ammonia to reduce hydrogen bonding in the cellulosic fiber, and then processed by aqueous wetting with aqueous formaldehyde and catalyst according to the present invention.

The liquid ammonia treatment process is particularly effective at increasing the strength of light weight cellulosic fiber-containing fabric.

In the second stage, the invention controls the moisture level of cellulosic fiber-containing fabric in the catalytic aqueous formaldehyde curing process in the precise manner to retain both a sufficient volume of formaldehyde and catalysts for the desired level of cross-linking without—or controlling—its evaporation with moisture, and at the same time, adequate and enough volume of moisture to prevent the increase of hydrogen bonding in cellulosic fiber at curing.

For such control of the moisture, the fabrics are cured in the manner according to either (I), (II), (III), or (IV), below.

I. Saturated Steam Cure

Saturated steam does not deplete the moisture content of the fabric. In such case, the fabric is treated to contain the precise volume of aqueous formaldehyde and/or of the catalyst necessary to obtain the desired level of cross-linking with or without one or more moisture absorbent substances at the desired level of moisture content to prevent the increase of hydrogen bonding in the cellulosic fiber.

However, formaldehyde requires heating up to about 350° F. to cure for cross-linking of cellulosic molecules, depending on the moisture/formaldehyde ratio, type of catalyst, type of heating, timing of heating, etc.

Generally, the catalysts of ammonium salts, sulfates and other sulfur related acids such as sulfuric acid, sulfurous acid, methane sulfonic acid, etc. are active at lower temperatures from about 200° F. to 280° F. as opposed to metallic acids such as aluminum chloride, magnesium chloride, etc. at over 300° F.

There are four (4) practical new methods for heating the fabric in saturated steam without any substantial loss of moisture for curing.

No. 1. Saturated steam heating under atmospheric pressure is effective for the heat-curing of aqueous formaldehyde at temperatures of 212° F. or less in case the required heating is not higher than 212° F. for the desired curing.

No. 2. Saturated high pressure (superheated) steam is ideal for heat-curing of aqueous formaldehyde at the temperature of more than 212° F. (water boiling point)due to no loss of moisture.

No. 3. The combination of saturated steam and infrared radiation is also contemplated. Far-infrared and infrared are useful to raise the temperature of the fabric without or almost without raising the temperature of the atmosphere. The exposure of the fabric to far-infrared or infrared takes place either inside of a saturated-steam chamber or a separate process immediately after a saturated steam chamber.

No. 4. The combination of saturated steam and high frequency induction radio wave is also contemplated. High frequency radio waves (so called microwaves) are useful to raise the temperature of the fabric without or almost without raising the temperature of the atmosphere. The exposure of the fabric to high frequency radio waves takes place inside a saturated steam chamber or a separate process immediately after a saturated steam chamber. The range of wave lengths of such high frequency induction radio wave curing is the same as the wave lengths which cause water to become heated.

II. Superheated Steam Curing Durable Press Process

The other method is to use superheated steam with or without the moisture retaining additives to aqueous formaldehyde and a catalyst at the treatment of the fabric in order to prevent the loss of moisture in cellulosic fiber at the heat-curing.

Superheated steam has the following characteristics:

| Atmospheric superheated steam temperature | | relative humidity |
|---|---|---|
| 212° F. | (100° C.) | 100% |
| 213.8 | (101) | 96.5 |
| 215.6 | (102) | 93.1 |
| 217.4 | (103) | 90 |
| 219.2 | (104) | 86.9 |
| 221 | (105) | 83.8 |
| 230 | (110) | 70.7 |
| 248 | (120) | 51 |
| 266 | (130) | 37.5 |
| 284 | (140) | 28 |
| 302 | (150) | 21.3 |
| 330 | (160) | 15.6 |
| 348 | (170) | 12.5 |
| 356 | (180) | 9.8 |

The prior art has employed dry heating which has almost humidity at temperatures at or higher than 212° F. (100° C.). However, generally speaking, superheated steam has much higher humidity than dry heating, which will reduce the depletion of humidity from the fabric. Therefore, aqueous formaldehyde is not depleted from the fabric as opposed to dry heating.

The great merit of superheated steam curing is its control of relative humidity in the atmosphere. Regardless of whether atmospheric humidity is high or low, superheated steam has a fixed relative humidity at a given temperature. For example, if superheated steam is controlled at 120° C., it always has 51% relative humidity as opposed to dry heating which has no control of humidity in the atmosphere. Thus, by controlling the temperature of superheated steam, relative humidity is automatically controlled, then the extent of depletion of aqueous formaldehyde and catalyst from the fabric at cross-linking (curing temperature) is subsequently precisely controlled.

In this case, the fabric is treated in the beginning with increased volume of moisture, aqueous formaldehyde and catalyst in aqueous wetting process to the same extent in which the fabric loses moisture content at curing temperature.

The initial moisture content in the fabric is also designed to maintain the level necessary to prevent the increase of hydrogen bond at curing. Moisture retaining additives further reduce the depletion of moisture from fabric at curing. Such additives should not contain hydro-oxyl (OH) in their molecules which react with formaldehyde and cause the fabric to become hardened.

III. Moist Cure

The precise manner of control of moisture content can be achieved by moist cure which comprises rolling up the fabric along with the desired level of moisture and aqueous formaldehyde with catalyst after aqueous wetting by padding, dipping, spraying, etc. and covering the rolled up fabric with plastic sheet or film to seal off the evaporation of moisture from the rolled up fabric. The very precise manner of control of moisture content is easily achieved.

The cross-linking of formaldehyde with cellulose molecule occurs at moderate room temperature in a gradual manner over long hours. Table 2, supra, shows a moist cure cross-linking formula with aminoplastic resin reported by Cotton Inc. Substantial improvement of tear, tensile and abrasion strength against dry cure is achieved as a result of the reduction of hydrogen bond. Its great wrinkle-free/resistance enhancing effect is shown in Table 3 on page 117 of the aforementioned Masuda et al. reference.

The present invention uses aqueous formaldehyde with catalyst instead of amino-plastic resin for cross-linking under the same precise way of moisture content control, and as such no prior art teaches the invention.

Moist cure with aqueous formaldehyde with catalyst may be assisted by far-infrared or infrared and/or high frequency induction radio wave. After rolling up the fabric with the desired level of moisture and aqueous formaldehyde with catalysts, the roll is placed in closed chamber with temperature and humidity control. While the fabric is transferred to another empty roll in the same chamber, the fabric is exposed to far-infrared or infrared and/or high frequency induction radio waves to the extent necessary to cross-linking aqueous formaldehyde with cellulose molecule.

IV. Mild Cure

Although not as precise as saturated steam cure, superheated steam cure and moist cure in controlling moisture level, mild cure, using less than 212° F. (100° C.) steam, shown in Table 1, is also effective in the catalytic cross-linking of aqueous formaldehyde with hydroxyl group-containing molecules in cellulosic fiber-containing fabrics to achieve a high level of wrinkle-free/resistance property and higher strength.

In the present invention, mild cure using steam at below 212° F. enables the retention of enough of a moisture level to contain aqueous formaldehyde with catalysts necessary to achieve the desired degree of cross-linking and moisture at curing to prevent the increase of hydrogen bonding and thus preserving the desired level of tear, tensile and abrasion strength. The control of steam temperature less than 212° F. (100° C.) in a constant manner requires well-structured steaming equipment and good control of steam pressure.

Moisture retaining additives for any of the above curing methods further reduce the depletion of humidity from fabric at curing. Such additives should not contain hydrooxyl (OH) in their molecules which react with formaldehyde and make the fabric hardened.

III. Cross-linking control factors

There are three ways to control the extent of cross-linking. One way is to control the volume of formaldehyde (0.5% to 20% of fabric weight depending on the desired level of cross-linking), in the presence of more than enough (excess) catalyst. The second is to control the volume of catalyst (0.01% to 10% of fabric weight, depending on the desired level of cross-linking) in the presence of more than enough formaldehyde. For example, liquid formaldehyde (37% formaldehyde, 5% methanol, 48% water) volume of about 0.5% to 20% of fabric weight is applied to the fabric to control the desired level of wrinkle-free property in the presence of abundant catalyst. The catalyst can be any acid substance, including Lewis acids such as magnesium chloride and aluminum chloride, methanesulfonic acid, paratoluenesulphonic acid, sulfuric acid, sulfurous acid, sulfur dioxide, hydrochloric acid, and the like.

Heating temperature varies up to about 350° F., depending on the type of catalyst. For example, sulfur dioxide requires about 265° F.; aluminum chloride requires almost 320° F.

The third is to control precisely the respective volumes of both formaldehyde and catalyst.

In sum, formaldehyde is the best chemical for wrinkle-resistant finishing of cellulosic fiber-containing fabric. It preserves the water (moisture) absorbency and naturalness of cellulose fiber as opposed to resin (aminoplast) finish which covers cellulosic fiber with aminoplastic film and reduces water (moisture) absorbency. However, only vapor phase formaldehyde curing has been successfully applied to commercial production. The easiest way is to apply aqueous formaldehyde to the fabric by padding or dipping or spraying, etc., but it has never materialized as a viable commercial process due to the substantial water (moisture) evaporation with formaldehyde from the fabric which occurs in the dry heating process. The quantitative control of aqueous formaldehyde has been impossible in dry heating and curing according to the prior art.

Furthermore, the quantitative control of moisture in cellulosic fiber is essential in reducing the strength loss by preventing the increase of hydrogen bonds in cellulosic fiber, particularly for light weight 100% cotton fabric.

This invention achieves such precise moisture control for quantitative control of both aqueous formaldehyde with catalysts and moisture level necessary to prevent the increase of hydrogen bonds, utilizing the following curing methods:

(1) saturated steam cure with or without high pressure and/or far-infrared or infrared and/or high frequency radio wave with or without moisture retaining additive.

(2) superheated steam cure with or without far-infrared or infrared and/or high frequency radio wave, with or without moisture retaining additive.

(3) moist cure with or without far-infrared or infrared and/or high frequency radio wave, with or without moisture retaining additive.

(4) mild cure with or without far infrared or infrared and/or high frequency radio waves, and with or without moisture retaining additive.

Before any form of the above curing, the fabric is processed in aqueous wetting such as padding, dipping, spraying, etc., to impregnate formaldehyde with catalysts and to reduce the hydrogen bonds in cellulosic fiber with or without prior treatment by liquid ammonia, then treated to reach the desired content level of moisture and formaldehyde with catalysts before curing.

3. DESCRIPTION OF PREFERRED EMBODIMENTS

3.1 Example of Saturated Steam Cure (I)

Cellulosic fiber-containing fabric is processed with liquid ammonia treatment, padded with aqueous solution of 37% formaldehyde with catalyst, sulfur dioxide and squeezed to 100% pick-up to give about 0.5% to 20% (based on fabric weight) formaldehyde and 0.01% to 10% (of fabric eight) catalyst and 0.1% nonionic wetting agent to the fabric. At curing, the fabric is processed at 280° F. in a saturated steam chamber (212° F.) with the help of far-infrared or infrared and/or high frequency radio waves. Then the fabric is washed and dried.

The volumes of formaldehyde and catalyst are adjusted according to the type of cellulosic fiber, the type of fabric, the desired level of wrinkle-resistance, etc. The temperature during the curing step is adjusted according to the type of catalyst used. For example, sulfur dioxide is used when curing at 265° F. to 280° F., aluminum chloride is used when curing at 320° F.; methane sulfonic acid is used when curing at 230° F., etc.

3.2 Example of Saturated Steam Cure (II)

Cellulosic fiber-containing fabric is processed with liquid ammonia treatment, padded with aqueous solution of 37% formaldehyde with catalyst, magnesium chloride $MgCl_2.6H_2O$ and wetting agent, and then squeezed to 100% pick-up to give about 0.5% to 20% formaldehyde and 0.01% to 10% catalyst with 0.1% wetting agent.

At curing, the fabric is processed at 330° F. in a high pressure saturated steam, then washed and dried.

The volumes of formaldehyde and catalyst are adjusted according to the type of cellulosic fiber, the type of fabric and the desired level of wrinkle-resistance.

3.3 Example of Superheated Steam Cure

Cellulosic fiber-containing fabric is processed with liquid ammonia treatment, dipped in the aqueous solution of 37% formaldehyde with catalyst, sulfur dioxide, then squeezed to 100% pick-up to give 0.5% to 20% formaldehyde and 0.01% to 10% catalyst to the fabric.

Curing at 280° F. which is an adequate temperature for sulfur dioxide catalyzed cross-linking, the fabric rapidly loses moisture at 37.5% relative humidity atmosphere of 280° F. superheated steam.

The extent of moisture loss in fabric is subject to timing of curing. Supposing the curing time is 5 minutes and the loss of moisture is 50%, then formaldehyde content in solution is increased by double if the original solution contains the adequate amounts (volumes) of formaldehyde and catalyst at no moisture loss curing.

It is the great advantage of superheated steam curing that the fixed temperature has the fixed relative humidity which enables the precise control loss of moisture constant at any time. After curing, the fabric is washed and dried.

3.4 Example of Moist Cure

100% cotton shirting is processed with liquid ammonia treatment, padded by the aqueous solution of 37% formaldehyde with catalyst HCl (conc) and wetting agent, then squeezed to 70% pick-up to give 0.5% to 20% formaldehyde and 0.01% to 10% catalyst and 0.1% wetting agent to the fabric.

The fabric is dried to 5% to 15% moisture content and rolled up. The roll is completely covered by plastic sheet to prevent moisture evaporation. The fabric is cured at 15° C. to 30° C. in 5 to 30 hours depending on the desired level of wrinkle-resistance. Then the fabric is washed and dried.

This precise control of moisture content at curing prevents the increase of hydrogen bonds at curing and substantially preserves the tear, tensile and abrasion strengths of fabric obtained at pre-treatment with aqueous wetting and/or liquid ammonia.

3.5 Example of Mild Cure

With or without liquid ammonia, 100% cotton chino is padded with an aqueous solution of 37% formaldehyde with catalysts, $MgCl_2.6H_20$ (50%) and citric acid (50%) and wetting So agent, then squeezed to give 0.5% to 20% formaldehyde, 0.01% is to 10% catalyst and 0.1% wetting agent to the fabric and dried to 4 to 10% moisture level. The fabric is cured at 167° F. (75° C.). Then the fabric is washed and dried.

What is claimed is:

1. A durable press process with control of hydrogen bonding for cellulosic fiber-containing fabrics, comprising:

treating the fabric by contacting it with aqueous formaldehyde and a catalyst in liquid form for the cross-linking reaction between formaldehyde and a cellulose molecule, wherein the catalyst is an acid catalyst excluding sulfur dioxide; and curing the treated fabric in a curing zone under a precisely controlled moisture level and at a temperature or with an increase in the temperature of the fabric by means which directly imparts heat to the fabric without disturbing the temperature in the curing zone, while precisely controlling the loss of moisture, formaldehyde and the catalyst, in the fabric during the curing so as to control precisely the level of cross-linking and hydrogen bonding of cellulose molecules in the fabric, wherein the precisely controlled moisture level is attained by a means selected from the group consisting of saturated steam, superheated steam, moist cure, and mild cure.

2. The process of claim 1 wherein the controlled moisture level in the curing zone is attained by means of saturated steam.

3. The process of claim 1 wherein the controlled moisture level in the curing zone is attained by means of superheated steam.

4. The process of claim 1 wherein the controlled moisture level in the curing zone is attained by means of moist cure, which comprises:

rolling up the fabric along with the desired level of moisture and formaldehyde with the catalyst:

covering the rolled up fabric with a moisture-impervious sheet or film to seal off the evaporation of moisture; and curing the fabric at a room temperature between about 15° C. and 30° C. for about 5 to about 30 hours.

5. The process of claim 1 wherein the controlled moisture level in the curing zone is attained by means of mild cure, which comprises:

curing in the steam below 212° F. with control of constant level of moisture, temperature and pressure of the steam.

6. The process of claim 1 wherein the increase in the temperature of the fabric in the curing zone is brought about by means selected from the group consisting of far infrared or infrared radiation and high frequency radio waves.

7. The process of claim 1 wherein the curing zone temperature during the heat-curing step is increased within a range of up to about 350° F.

8. The process of claim 1 wherein the acid catalyst is selected from the group consisting of sulfurous acid, sulfuric acid, methanesulfonic acid, paratoluenesulphonic acid, magnesium chloride, aluminum chloride and hydrochloric acid.

9. The process of claim 1 which further comprises pretreating the fabric at the outset of the process with liquid ammonia and/or aqueous wetting with or without a moisture retaining additive so as to achieve an initial reduced level of hydrogen bonding in the fiber, wherein the aqueous wetting may be achieved simultaneously with the treatment of the fabric with aqueous formaldehyde and the catalyst.

10. The process of claim 1 wherein the concentration of formaldehyde in the aqueous formaldehyde and the concentration of catalyst are between about 0.5 and 20% and between about 0.01 and 10%, respectively, based on the weight of the fabric.

11. A wrinkle-free/resistant cellulosic fiber-containing fabric obtained according to the process of claim 1.

12. A durable press process for cellulosic fiber-containing fabrics, comprising:

treating the fabric by contacting it with aqueous formaldehyde and a catalyst in liquid form for the cross-linking reaction between formaldehyde and cellulose;

curing the treated fabric in a curing zone under a controlled moisture level and at a temperature or with an increase in the temperature of the fabric by means selected from the group consisting of far infrared or infrared radiation and high frequency radio waves, thereby directly imparting the heat to the fabric without disturbing the temperature in the curing zone, while controlling the loss of moisture, formaldehyde and the catalyst in the fabric during the curing so as to control precisely the level of cross-linking and hydrogen bonding of cellulose molecules in the fabric.

* * * * *